US005547523A

United States Patent [19]

Blankenship, Jr. et al.

[11] Patent Number: 5,547,523

[45] Date of Patent: Aug. 20, 1996

[54] RETAINED STRAIN FORGING OF NI-BASE SUPERALLOYS

[75] Inventors: Charles P. Blankenship, Jr., Niskayuna; Michael F. Henry, Schenectady, both of N.Y.

[73] Assignee: General Electric Company, Schenectady, N.Y.

[21] Appl. No.: 367,635

[22] Filed: Jan. 3, 1995

[51] Int. Cl.[6] ..... C22F 1/10

[52] U.S. Cl. ..... 148/677; 148/556; 419/28; 419/29

[58] Field of Search ..... 148/675, 555, 148/676, 677, 556; 419/28, 29

[56] References Cited

U.S. PATENT DOCUMENTS

| | | | |
|---|---|---|---|
| 4,579,602 | 4/1986 | Paulonis et al. | 148/677 |
| 4,820,358 | 4/1989 | Chang . | |
| 5,302,217 | 4/1994 | Gostic et al. | 148/675 |
| 5,393,483 | 2/1995 | Chang | 148/677 |

FOREIGN PATENT DOCUMENTS

| | | | |
|---|---|---|---|
| 9218659 | 10/1992 | WIPO | 148/677 |
| 9413849 | 6/1994 | WIPO | 148/677 |

OTHER PUBLICATIONS

Dictionary of Metallurgy; A. D. Merriman, 1958 pp. 114–115.

*Primary Examiner*—George Wyszomierski
*Assistant Examiner*—Margery S. Phipps
*Attorney, Agent, or Firm*—William H. Pittman

[57] ABSTRACT

A method of forging to impart a critical amount of retained strain is described for Ni-base superalloys, particularly those which comprise a mixture of $\gamma$ and $\gamma'$ phases, and most particularly those which contain at least about 40 percent by volume of $\gamma'$. This forging method harnesses nucleation-limited recrystallization, a phenomenon which has been known in the past to produce uncontrolled, non-uniform Critical grain growth, to produce forged articles having a uniform average grain size in the range of about 90–120 microns. The method comprises the selection of a forging preform formed from a Ni-base superalloy. Isothermal sub-solvus forging is then used to form a precursor forging which has a near-net shape. The precursor forging is then forged using relatively high strain rate techniques, such as hammer forging, hot die forging or room temperature forging, to impart all or some portion of it with a critical amount of retained strain energy. The forging is then given a final subsolvus soak and supersolvus anneal to form the uniform grain structure.

7 Claims, 4 Drawing Sheets

RETAINED STRAIN FORGING OF NI-BASE SUPERALLOYS

FIELD OF THE INVENTION

This invention is generally directed to a method for forging Ni-base superalloy articles so as to impart sufficient retained strain energy to them to provide a basis for subsequent recrystallization and the creation of a substantially uniform large grain microstructure. Specifically, the method comprises the selection of a forging preform formed from a Ni-base superalloy. Isothermal subsolvus forging is then used to form a precursor forging which has a near-net shape. The precursor forging is then forged using relatively high strain rate techniques, such as hammer forging, hot die forging or room temperature forging, to impart all or some portion of it with a critical amount of retained strain energy. The forging is then given a final subsolvus soak and supersolvus anneal to form the uniform grain structure.

BACKGROUND OF THE INVENTION

Advanced Ni-base superalloys are currently isothermally forged at relatively slow strain rates and temperatures below their γ' solvus temperatures. Forging is typically followed by supersolvus annealing. This method tends to minimize forging loads and die stresses, and avoids fracturing the items being formed during forging operations. It also permits superplastic deformation of these alloys in order to minimize retained metallurgical strain at the conclusion of the forming operations. However, this method can have substantial limitations with respect to forming substantially uniform fine grain size articles. While the method tends to produce relatively fine-grain as-forged microstructures having an average grain size on the order of about 7 μm, subsequent supersolvus annealing causes the grain size to increase to about 20–30 μm. Also, unless the forging process is carefully controlled so as to avoid imparting retained strain into the forged articles, this method can produce articles that are subject to the problem of critical grain growth, wherein the retained strain energy in the article is sufficient to cause limited nucleation and substantial growth (in regions containing the retained strain) of very large grains upon subsequent supersolvus annealing. Critical grain growth can cause the formation of gains as large as 300–3000 μm.

It is desirable to form uniform large gain microstructures in these Ni-base superalloys to enhance their high temperature creep and crack propagation resistance, such as microstructures having an average gain size in the range of 90–120 microns. Controlled large gain sizes are known to be difficult, if not impossible, to produce using isothermal forging. Isothermal subsolvus forging is also known to require very careful process control in order to avoid imparting low levels of retained strain energy to the forged parts that can result in critical gain growth upon subsequent annealing of the forging. It is also very desirable to avoid the problem of critical gain growth.

Therefore, new methods of forging are desirable to produce forged articles which avoid critical grain growth, as well as methods that would enable the development of uniform large gain microstructures.

SUMMARY OF THE INVENTION

This invention describes a method for producing uniform large gain microstructures having an average gain size in the range of 90–120 microns. It further avoids the problem of critical gain growth by harnessing this phenomenon to form the uniform gain microstructure.

This invention describes a method of forging an article having a controlled grain size from a Ni-base superalloy, comprising the steps of: selecting a forging preform formed from a Ni-base superalloy and having a microstructure comprising a mixture of γ and γ' phases, wherein the γ' phase occupies at least 40% by volume of the Ni-base superalloy; isothermally forging the preform at a temperature in the range of about 0°–100° F. below a γ' solvus temperature of the alloy for a time sufficient to form the preform into a precursor forging; forging at least a portion of the precursor forging so as to produce a forged article having a critical amount of retained strain energy per unit of volume Within the forged portion of the forged article; subsolvus annealing the forged article at a temperature in the range of about 0°–100° F. below the γ' solvus temperature of the alloy; and supersolvus annealing the article at a supersolvus temperature in the range of about 0°–100° F. above the solvus temperature for a time sufficient to ensure that substantially all of the forged article is raised to the supersolvus temperature, wherein the critical amount of retained strain energy per unit of volume stored during forging is sufficient to promote the growth of a uniform average grain size in the range of about 90–120 microns within the forged portion of forged article upon supersolvus annealing.

The method also may comprise the step of cooling the article to a temperature lower than the γ' solvus temperature at a controlled cooling rate immediately after the step of supersolvus annealing.

One object of the method of the present invention is to produce a forged article from Ni-base superalloys having a critical amount of retained strain energy per unit of volume in the forged portion to promote substantially uniform subsequent recrystallization of the forged microstructure.

A second object is to produce a forged and annealed article from Ni-base superalloys having a uniform large grain size, in the range of about 90–120 microns.

A significant advantage of the method of the present invention is that it avoids the problem of critical grain growth.

Another advantage of the method of the present invention, is that it produces uniform large gain size Ni-base superalloys.

Another advantage of the present invention is that the uniform large grain size improves the creep and crack propagation resistance of the forged article as compared to the same articles having a fine grain size The foregoing objects, features and advantages of the present invention may be better understood in view of the description contained herein, particularly the following drawings and specification.

DETAILED DESCRIPTION OF THE INVENTION

Applicants have invented a method of forging which may be utilized to produce forged articles from Ni-base superalloys having a substantially-uniform large grain size with an average size of about 90–120 microns. The method utilizes high strain rate forging, subsolvus annealing and supersolvus annealing to recrystallize the microstructure and form the large gain size. The gain size is achieved by imparting a critical level of retained strain per unit of volume throughout the article during the forging operation, and subsequent recrystallization. This method harnesses the phenomenon of nucleation limited recrystallization and gain growth to produce the uniform large grain size. This method is contrary to well-known forging practice, where it is known to avoid nucleation limited recrystallization and gain growth in order to avoid the associated problem of critical gain growth. This method is preferred for making forgings having a relatively simple geometry, such as simple pancake forgings for disks.

Figure 1:
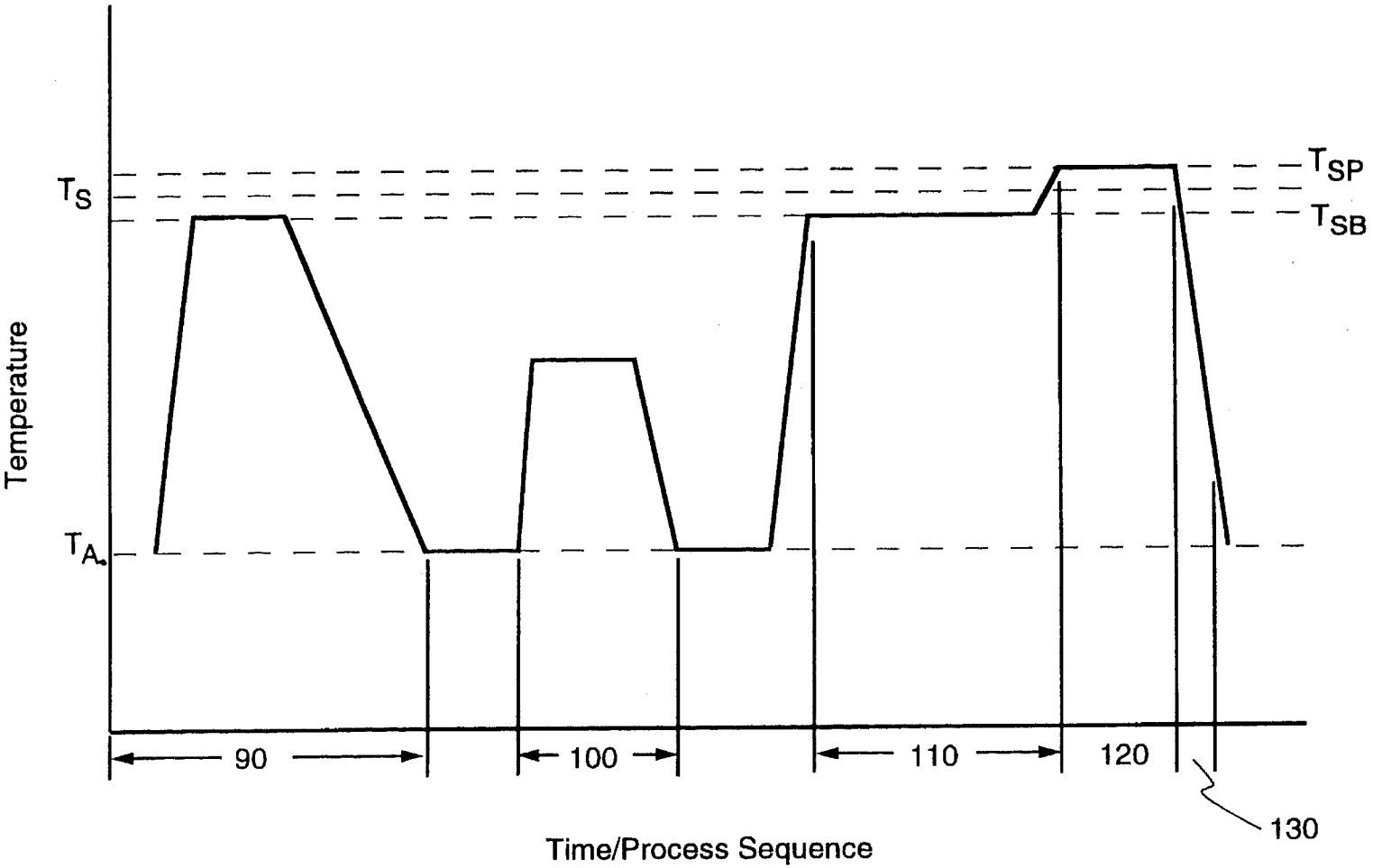
FIG. 1 is a schematic representation of a method of forging of the present invention.
Figure 2:
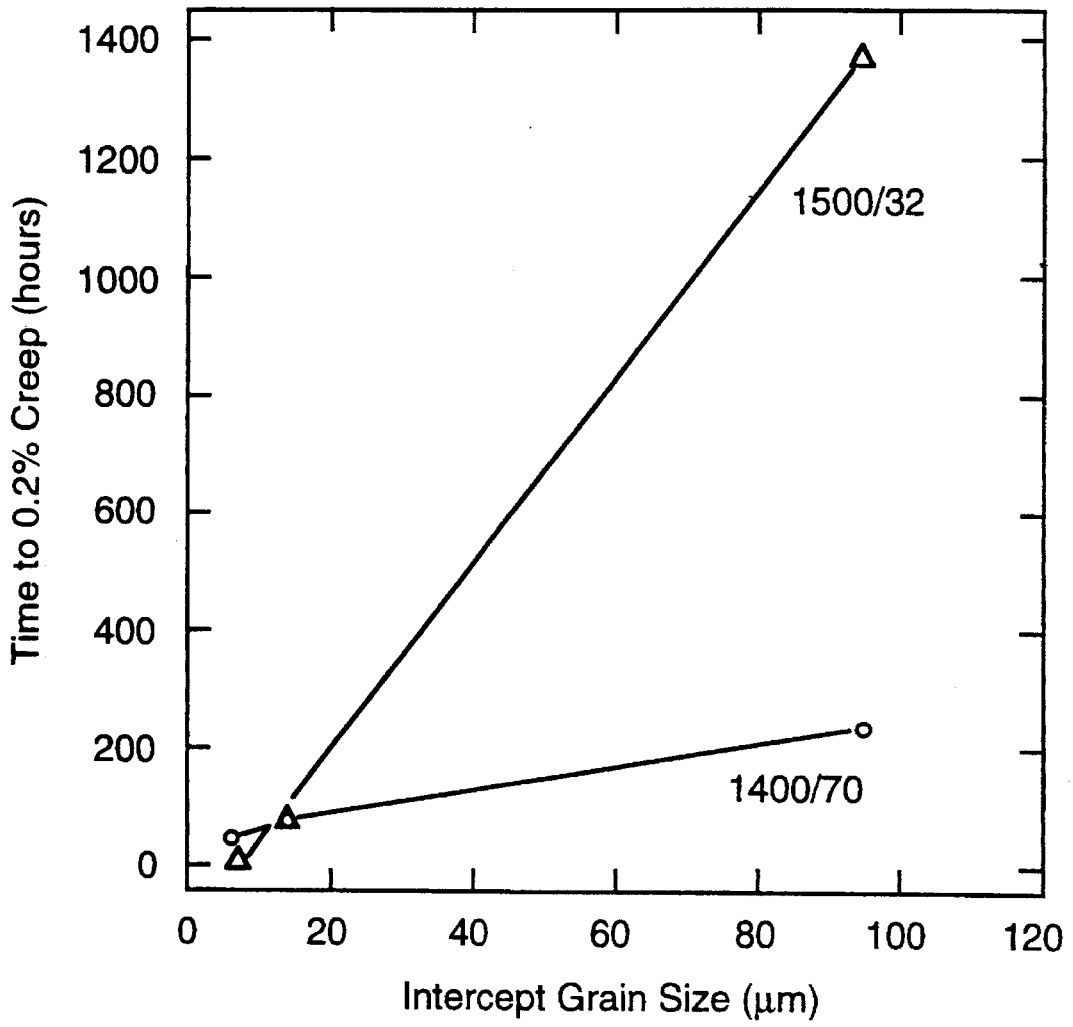
FIG. 2 is a plot of creep resistance as a function of grain size in a Rene'88 alloy.

Referring to FIG. 1, the method of this invention comprises the steps of: selecting a forging preform formed from a Ni-base superalloy and having a microstructure comprising a mixture of $\gamma$ and $\gamma'$ phases, wherein the $\gamma'$ phase occupies at least 40% by volume of the Ni-base superalloy; isothermally forging the preform at a subsolvus temperature ($T_{SB}$) in the range of about 0°–100° F. below the $\gamma'$ solvus temperature ($T_S$) of the alloy for a time sufficient to form the preform into a precursor forging; forging at least a portion of the precursor forging so as to produce a forged article having a critical amount of retained strain energy per unit of volume within the forged portion of the forged article; annealing the forged article at a subsolvus temperature ($T_{SB}$) in the range of about 0°–100° F. below the $\gamma'$ solvus temperature of the alloy; and supersolvus annealing the article at a supersolvus temperature ($T_{SP}$) in the range of about 0°–100° F. above the solvus temperature for a time sufficient to ensure that substantially all of the forged article is raised to the supersolvus temperature, wherein the critical amount of retained strain energy per unit of volume stored during forging is sufficient to promote the growth of a uniform average gain size in the range of about 90–120 microns within the forged portion of forged article upon supersolvus annealing.

The method begins with the step of selecting a forging preform formed from a Ni-base superalloy and having a microstructure comprising a mixture of $\gamma$ and $\gamma'$ phases, wherein the $\gamma'$ phase occupies at least 40% by volume of the Ni-base superalloy. These alloys characteristically have substantially $\gamma$ gains, with $\gamma'$ distributed both within the grains and along the grain boundaries, with the distribution of the $\gamma'$ phase depending largely on the thermal processing of the alloy. Such alloys are well-known for use in applications where high strength and creep resistance are required at high temperature, such as for use in the hot sections of aircraft engines. A forging preform (not illustrated) may be of any desired size or shape that serves as a suitable preform, so long as it possesses characteristics that are compatible with being formed into a forged article, as described further below. It is preferred in the method of this invention, that the preform be of a relatively simple geometry, such as a forging mull (right cylindrical disk) or pancake. This is related to the fact that this method is preferred for making forgings having a simple geometry, and the requirement that a portion of the forging be formed so as to retain a particular amount of strain, as explained further below The preform may be formed 80 by any number of well-known techniques, however, the finished forging preform should have a relatively fine gain size within the range of about 1–50 μm. In a preferred embodiment, the forming of the forging preform is accomplished by hot-extruding a Ni-base superalloy powder, such as by extruding the powder at a temperature sufficient to consolidate the particular alloy powder into a billet, blank die compacting the billet into the desired shape and size, and then hot-extruding to form the forging preform. For Rene'88 powder, the hot-extrusion was performed at a temperature of about 1950° F. Preforms formed by hot-extrusion typically have a gain size on the order of 1–5 μm. Another method for forming preforms may comprise the use of spray-forming, since articles formed in this manner also characteristically have a grain size on the order of about 20–50 μm. The method of the present invention does not require the actual forming of an alloy preform as part of the method. It is sufficient as a first step of the method of the present invention to merely select a Ni-base superalloy preform having the characteristics described above. The selection of forging preform shapes and sizes in order to provide a shape that is suitable for forging into a finished or semifinished article is well known.

The method of the present invention is principally directed toward use with Ni-base superalloys that exhibit a mixture of both $\gamma$ and $\gamma'$ phases, and in particular those superalloys that have at least about 40 percent or more by volume of the $\gamma'$ phase present at ambient temperatures. Table 1 illustrates a representative group of Ni-base superalloys for which the method of the present invention may be used and their compositions in weight percent.

TABLE 1

| | | | Alloys | | | |
|---|---|---|---|---|---|---|
| Element | Rene '88 | Rene '95 | IN-100 | U720 | Wasp-aloy | Astro-loy |
| Co | 13 | 8 | 15 | 14.7 | 13.5 | 15 |
| Cr | 16 | 14 | 10 | 18 | 19.5 | 15 |
| Mo | 4 | 33 | 3 | 3 | 43 | 5.25 |
| W | 4 | 3.5 | 0 | 1.25 | 0 | 0 |
| Al | 1.7 | 3.5 | 5.5 | 2.5 | 1.4 | 4.4 |
| Ti | 3.4 | 2.5 | 4.7 | 5 | 3 | 3.5 |
| Ta | 0 | 0 | 0 | 0 | 0 | 0 |
| Nb | 0.7 | 3.5 | 0 | 0 | 0 | 0 |
| Fe | 0 | 0 | 0 | 0 | 0 | 0.35 |
| Hf | 0 | 0 | 0 | 0 | 0 | 0 |
| Y | 0 | 0 | 1 | 0 | 0 | 0 |
| Zr | 0.05 | 0.05 | 0.06 | 0.03 | 0.07 | 0 |
| C | 0.05 | 0.07 | 0.18 | 0.041 | 0.07 | 0.06 |
| B | 0.015 | 0.01 | 0.014 | 0.03 | 0.006 | 0.03 |
| Ni | bal. | bal. | bal. | bal. | bal. | bal. |

FIG. 1 is a schematic representation of a preferred embodiment of the method or process of the present invention. FIG. 1 illustrates the process temperature as a function of the process sequences, as well as particular time intervals within some of the process sequences, except that it does not illustrate the step of selecting the forging preform.

Referring to FIG. 1, after selecting a Ni-base superalloy preform, the next step in the method is the step of isothermally forging 90 the preform at a subsolvus temperature ($T_{SB}$) in the range of about 0°–100° F. below the $\gamma'$ solvus temperature of the alloy for a time sufficient to form the preform into a precursor forging (not shown). Isothermal forging 90 is done at a subsolvus temperature with respect to the selected Ni-base superalloy. For Rene'88, the solvus temperature is about 2,025° F., and the preferred temperature for performing forging 90 is about 1,925° F. The strain rate employed is not critical. Generally this forging step is used to produce superplasticity with the article being forged, so as to result in a minimum of metallurgical or retained strain in the forged article, however, in this method, it is not necessary to achieve a minimum of retained strain, because the next step introduces retained strain into the forging. The only limitation is that it is preferred not to perform isothermal forging such that it leaves a level of retained strain that is higher than the amount to be introduced in subsequent steps. Otherwise additional heat treatment will be necessary to reduce the retained strain to acceptable levels. Thus strain rates will be employed which tend to maximize the flow of the material within the limitations given. Strain rates will also be employed so as to not generate excessive stress levels in the forging dies. Applicants believe that strain rates in a range of about 0.0001–0.01 $s^{-1}$ will be acceptable for most superalloys. The isothermal forging step may be repeated as many times as necessary in order to form the precursor forging. The precursor forging is a near-net shape article with respect to the final forging as described below, because in the next step it is only necessary to introduce relatively small amounts of strain into the final forging. Also, the final forging step may only be used to shape a portion of the precursor forging. Other portions of the precursor forging may actually represent the final forging shape.

The next step is the step of forging 100 at least a portion of the precursor forging so as to produce a forged article having a critical amount of retained strain energy per unit of volume within the forged portion of the forged article. It is only necessary to forge a portion of the precursor forging, such as the rim of a forged disk, and not the entire forging. By forging 100 only a portion of the precursor forging, it is possible upon subsequent annealing to produce location specific grain sizes, and hence location specific properties within a forged article.

Applicants have determined that in order to obtain the subsequent recrystallization of the forged portion and the formation of a uniform large grain microstructure in the range of 90–120 microns that it is necessary to impart a critical level of retained strain energy into the forged portion of the forged article. This critical level of retained strain energy serves as the driving force for subsequent nucleation and growth of recrystallized grains. Therefore, this critical level of strain energy should be distributed throughout the microstructure of the forged portion, such that the critical level of retained strain should be on a per unit of volume basis. While it is difficult to measure the absolute levels of retained strain energy necessary, the strain energy levels in the forged portion of the forged article energy must be maintained so as to provide limited nucleation sites for subsequent recrystallization, and grain growth. This condition is what is believed to promote the growth of the large grains. The fact that the critical strain level is maintained is what is believed to promote the uniformity of the large grains and avoid non-uniform critical grain growth. A critical retained strain level is believed to create a relatively uniform distribution of grain nucleation sites in a given unit of volume within the forged portion. Therefore, even though the density of nucleation sites is limited as compared to what would be available at higher retained strain levels, the distribution of grain nucleation sites is believed to be uniform. Thus, as recrystallization and grain growth occur upon subsequent annealing, the uniform distribution of nucleation sites results in a uniform grain microstructure, which comprises large grains because of the originally limited number of nucleation sites (e.g. 90–120 micron average grain size). Because measurement of absolute values of retained strain energy is difficult to do, and not very amenable to a manufacturing environment, Applicants have characterized the necessary critical retained strain energy via an equivalency, namely the percentage of room temperature reduction in height necessary during forging. The range of critical retained strain energy using this measure was characterized for Rene'88 as being between 3–6% room temperature reduction in height. Similar results have been observed for the Ni-base superalloy Rene'95, and are expected for other Ni-base superalloys. This is within the range of about 1–6% room temperature reduction in height, where critical grain growth has been observed to occur in Rene'88. Thus the method of this invention avoids the problem of critical grain growth by harnessing it to produce a uniform large grain microstructure.

Relatively high strain rates are preferred in order to impart critical levels of retained strain energy as described above, on the order of 0.1–100 $s^{-1}$. These necessary strain levels and strain rates may be achieved by any suitable forging means and method, such as room temperature forging, hammer forging and hot die forging.

In the method of the invention, referring again to FIG. 1, the next step is the step of subsolvus annealing 110 the forged article at a temperature in the range of about 0°–100° F. below the $\gamma'$ solvus temperature of the alloy. For Rene'88, it is preferred that this step be done at a temperature of about 2,000° F., approximately 25° C. less than the $\gamma'$ solvus temperature. The annealing time for this step has a wide latitude. Annealing times of from 8–168 hours have been observed to result in uniform large grain microstructures. This step ensures that the recrystallization process is completed before going above the $\gamma'$ solvus temperature The final step is the step of supersolvus annealing 120 the article at a supersolvus temperature in the range of about 0°–100° F. above the solvus temperature ($T_{SP}$) for a time sufficient to ensure that substantially all of the forged article is raised to the supersolvus temperature, wherein the unpinning of the grain boundaries by the dissolution of the $\gamma'$ phase is sufficient to promote the growth of a uniform average grain size in the range of about 90–120 microns within the forged portion of forged article upon supersolvus annealing. The forged article is annealed in the range of about 15 minutes to 5 hours, depending on the thermal mass of the forged article and the time required to ensure that substantially all of the article has been raised to a supersolvus temperature. In addition to preparing the forged article for subsequent cooling to control the $\gamma'$ phase distribution, this anneal is also believed to contribute to the stabilization of the grain size of the forged article. Both subsolvus annealing 110 and supersolvus annealing 120 may be done using known means for annealing Ni-base superalloys.

Following the step of supersolvus annealing 120, the cooling 130 of the forged article may be controlled until the temperature of the entire article is less than the $\gamma'$ solvus temperature in order to control the distribution of the $\gamma'$ phase. Applicants have observed that in a preferred embodiment, the cooling rate after supersolvus annealing should be in the range of 100°–600° F./minute so as to produce both fine y particles within the $\gamma$ grains and $\gamma'$ within the grain boundaries. Typically the cooling is controlled until the temperature of the forged article is about 200°–500° F. less than $T_S$, in order to control the distribution of the $\gamma'$ phase in the manner described above. Faster cooling rates (e.g. 600° F./minute) tend to produce a fine distribution of $\gamma'$ particles within the $\gamma$ grains. Slower cooling rates (e.g. 100° F./minute) tend to produce fewer and coarser $\gamma'$ particles within the grains, and a greater amount of $\gamma'$ along the grain boundaries. Various means for performing such controlled cooling are known, such as oil quenching or the use of air jets directed at the locations where cooling control is desired.

EXAMPLE 1

Figure 3:
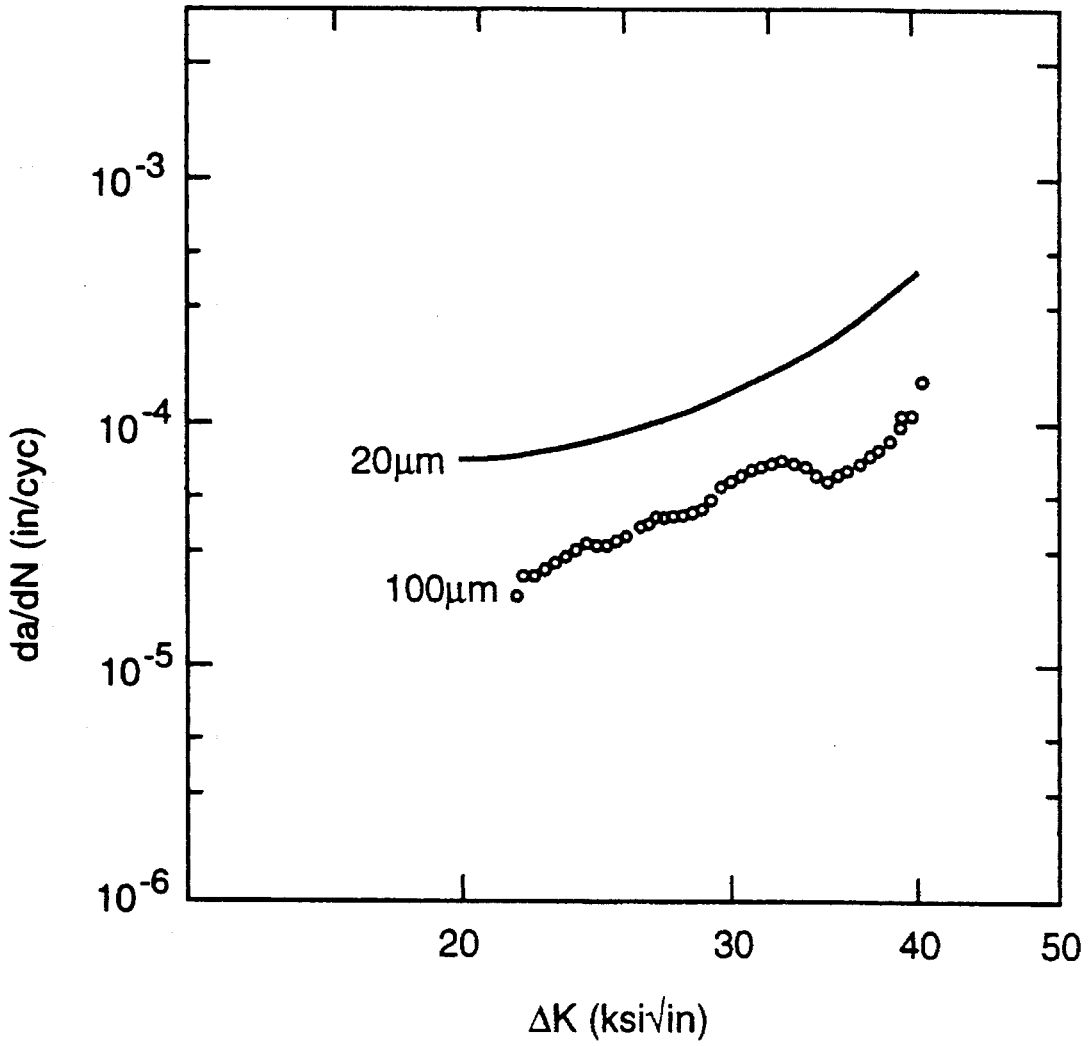
FIG. 3 is a plot of crack resistance as a function of grain size for a Rene'88 alloy.
Figure 4:
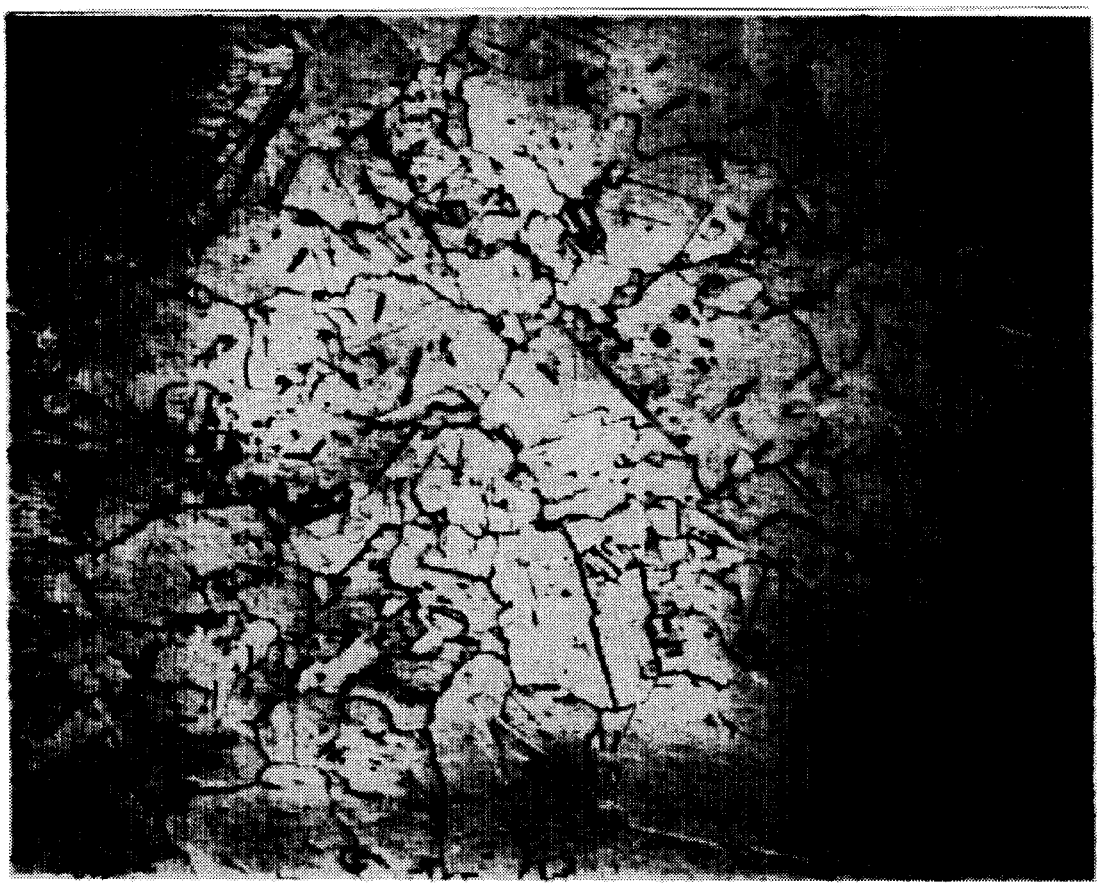
FIG. 4 is an optical photomicrograph at 50× magnification illustrating the grain size and morphology of a Rene'88 alloy forged using the method of the present invention.

To demonstrate the method of the invention, forging experiments were conducted on Rene'88, an Ni-base superalloy having the nominal composition shown in Table 1. A series of 1 inch by 1 inch by 4 inch blocks were compressed 4%, heat treated at 2,000° F. (below the γ' solvus temperature) for 168 hours, and then heat treated at 2,100° F. (above the γ' solvus) for 2 hours. The nominal grain size of the blocks prior to heat treatment averaged approximately 3–5 microns. The average grain size after the compression and heat treatments averaged approximately 100 microns, and was very uniform as shown in FIG. 4. Blocks of the original alloy and blocks of the heat treated alloy were both subjected to creep tests at 1,400° F./70 ksi and 1,500° F./32 ksi. The results are shown in Table 2 and FIG. 3. The forged blocks showed a significant improvement with respect to high temperature creep resistance. Crack propagation tests were also conducted at 1,200° F. using a constant cyclic load with tensile hold times of 90 seconds. The results are shown in FIG. 3. The improvement in crack propagation resistance was also significant. Crack propagation tests on forged blocks (e.g. 100 micron grains)were also conducted at 1,300° F., and the results would be nearly superimposed on the results of the 20 micron grain blocks at 1,200° F. shown in FIG. 3.

TABLE 2

| Grain Size μm (ASTM#) | Temp/Stress *F/ksi | Time to 0.2% (hours) | Time to Failure (hours) | Creep Rate ($s^{-1}$) |
|---|---|---|---|---|
| 15 μm (9) | 1400/70 | 79 | | 9.00E-09 |
| | | 62 | 246 | 8.00E-09 |
| | 1500/32 | 63 | | 6.00E-08 |
| | | 105 | 497 | 6.00E-08 |
| 90 μm (4) | 1400/70 | 214 | | 8.00E-09 |
| | | 244 | 398 | 6.00E-09 |
| | 1500/32 | 1405 | | 8.00E-10 |
| | | 1344 | 2357 | 8.00E-10 |

What is claimed is:

1. A method of forging an article having a controlled grain size from a Ni-base superalloy, comprising the steps of:

selecting a forging preform formed from a Ni-base superalloy and having a microstructure comprising a mixture of γ and γ' phases and a γ' solvus temperature, wherein the γ' phase occupies at least 40% by volume of the Ni-base superalloy;

isothermally forging the preform at a temperature that is 100° F. or less below the γ' solvus temperature at a strain rate in the range of 0.0001–0.01 $s^{-1}$ for a time sufficient to form the preform into a precursor forging;

forging at least a portion of the precursor forging at a strain rate in the range of 0.1–100 $s^{-1}$ so as to produce a forged article having an amount of retained strain energy per unit of volume sufficient to promote recrystallization within the forged portion of the forged article upon subsequent annealing;

subsolvus annealing the forged article at a temperature that is 100° F. or less below the γ' solvus temperature of the alloy for a time sufficient to recrystallize the microstructure of the forged portion; and supersolvus annealing the article at a supersolvus temperature that is 100° F. or less above the solvus temperature for a time sufficient to ensure that substantially all of the forged portion is raised to the supersolvus temperature and produce growth of the recrystallized microstructure within the forged portion to a uniform average grain size in the range of about 90–120 microns.

2. The method of claim 1, further comprising the step of cooling the article to a temperature lower than the γ' solvus temperature at a controlled cooling rate immediately after the step of supersolvus annealing.

3. The method of claim 2, wherein the controlled cooling rate is in the range of about 100°–600° F./minute.

4. The method of claim 1, wherein the second step of forging comprises room temperature forging, hammer forging or hot die forging.

5. The method of claim 1, wherein the subsolvus annealing time is in the range of 8–168 hours.

6. The method of claim 1, wherein the supersolvus annealing time is in the range of about 15 minutes to 5 hours.

7. The method of claim 1, wherein the amount of retained strain energy per unit of volume in the forged portion is equivalent to an amount of strain energy per unit of volume that would result in a sample of the same Ni-base superalloy if forged so as to produce a room temperature reduction in height of 3–5%.

* * * * *